US005152104A

United States Patent [19]

Wood et al.

[11] Patent Number: 5,152,104

[45] Date of Patent: Oct. 6, 1992

[54] ROTOR FINISHER

[75] Inventors: Charles L. Wood; Clarence E. Benton, both of Richmond, Va.

[73] Assignee: Accu Industries, Inc., Ashland, Va.

[21] Appl. No.: 686,315

[22] Filed: Apr. 16, 1991

Related U.S. Application Data

[63] Continuation of Ser. No. 405,896, Sep. 12, 1989, abandoned.

[51] Int. Cl.[5] ..... B24B 7/17

[52] U.S. Cl. ..... 51/118; 51/259; 51/132; 51/DIG. 3; 51/281 SF

[58] Field of Search ..... 51/281 SF, DIG. 3, 118, 51/117, 132, 259, 258

[56] References Cited

U.S. PATENT DOCUMENTS

| | | | |
|---|---|---|---|
| 1,836,542 | 12/1931 | Miller | 51/110 |
| 1,928,196 | 9/1933 | Betrancourt | 51/120 |
| 3,456,401 | 7/1969 | Kushmuk | 51/259 |
| 3,500,589 | 3/1970 | Ellege | 51/259 |
| 3,619,952 | 11/1971 | Leming | 51/132 |
| 3,691,878 | 9/1972 | Mitchell | 51/237 R |
| 4,262,452 | 4/1981 | Lopez | 51/281 SF |
| 4,361,988 | 12/1982 | Gramlich | 51/281 SF |
| 4,760,669 | 8/1988 | Maccaferri et al. | 51/132 |

FOREIGN PATENT DOCUMENTS

| | | | |
|---|---|---|---|
| 2513163 | 3/1983 | France | 51/118 |
| 1202829 | 1/1986 | U.S.S.R. | 51/118 |

OTHER PUBLICATIONS

Twenty-page brochure bearing the trademark Accu-Turn—A Turn for the Better and Design and showing equipment offered by Accu Industries, Inc., (Sep. 1988).

*Primary Examiner*—Robert A. Rose
*Attorney, Agent, or Firm*—Kilpatrick & Cody

[57] ABSTRACT

Devices and methods for imparting a nondirectional finish to brake rotors and similar articles. Such devices include two disks which are suspended against the rotor faces. The device suspends the disks with freedom of rotation in all directions and freedom of translation in a direction parallel to the rotational axis of the rotor. A follower presses each disk against its corresponding rotor face at a place located in the area between the disk centers and the rotor rotational axis. Rotor rotation causes the disks to spin, and an abrasive surface on the inside face of each disk provides a nondirectional finish as the disks float freely on the rotor surfaces about their follower contact points.

19 Claims, 4 Drawing Sheets

ROTOR FINISHER

This application is a continuation of copending application Ser. No. 07/405,896, filed Sept. 12, 1989, now abandoned.

This invention relates to apparatus and methods for imparting a nondirectional finish to brake rotors and similar articles.

BACKGROUND OF THE INVENTION

Automobiles, airplanes and other vehicles commonly feature disk brakes because of their advantages over drum brakes. Disk brake pads apply a flat, relatively small contact surface to a rotor as compared to a curved, larger brake shoe surface, so that disk brakes allow more precise control of braking action. Brake pad footprint on the rotor compared to total rotor surface is small, compared to the proportion of a brake drum in contact with shoes, so that disk brakes cool more efficiently and quickly and accordingly fade less than drum brakes.

Recent developments in automobile front wheel drive suspensions require thinner brake rotors and thus closer parallelism and runout tolerances. Increased use of metallic components in brake pads additionally requires far closer tolerances and a more perfect rotor finish to prevent squealing and other detrimental affects of harmonics.

Recent developments in anti-lock braking systems impose additional requirements for precision tolerances in brake rotors. Such systems employ sensors that gauge the pad-rotor gap to provide a feedback signal. That signal automatically adjusts brake pressure in order to reduce skidding and increase braking control. Scoring, runout and other imperfections in rotor shape and finish thus present erroneous signals and feedback to the detriment of braking control. Many automobile manufacturers accordingly require that brake rotors have a "non-directional" finish so that the rotor faces present as closely as possible a perfect planar surface to the brake pads.

Earlier brake rotor finishing devices employ several techniques in an effort to impart a "non-directional" finish to brake rotors. Although the adjective "non-directional" is commonly used in the automobile industry for rotor finishes which present no concentric, spiral or collinear scoring, typical "non-directional" finishers actually abrade rotors in many directions at a particular instant, but ideally accentuate finishing in no particular direction. This document refers to such finishers and finishes as "non-directional," consistent with industry custom.

One previous non-directional finisher applies a finish while the rotor remains in place on the automobile brake assembly. The device includes a frame which attaches to the brake caliper mount. The frame suspends and positions two coaxial, parallel abrading disks against the rotor surfaces. An adjustment knob allows control of pressure of disks against rotor. The disks place a non-directional finish on both faces of the rotor as they spin from friction imparted by the rotating rotor. This type of finisher, however, constrains the disks from translating (or moving laterally) in any direction and from rotating in any direction except to spin. Any imprecision in alignment between the caliper mount (and thus the finisher) and the rotor axis thus introduces errors and imperfections into the rotor finish. Such misalignment frequently exaggerates grinding action in particular directions on the rotor face, for example, and thus causes an imperfect non-directional finish as well as introducing error in planar flatness.

A second previous rotor finisher includes a mounting bracket that attaches to a brake lathe. The bracket supports an axle that carries a single abrasive disk. The bracket and axle force the disk against the rotor, and rotation of the rotor on the lathe causes the disk to rotate. The bracket constrains the axle (and the disk) from translating in any direction, so that misalignment of the bracket on the lathe introduces errors into the rotor finish.

A third previous rotor finisher includes a rotatable abrasive disk mounted perpendicularly to a handle at the end of a drive cable. The user connects the drive cable to a power source and manually applies the disk to the brake drum. This device obviously introduces the possibility of random errors in finish direction, runout, parallelism and flatness.

Other devices which have been used to finish brake rotors include sandpaper coated wood blocks and small abrasion pads attached to tong-like devices. Such devices can cause concentric scoring as well as errors in runout and parallelism.

SUMMARY OF THE INVENTION

Devices according to the present invention suspend a pair of disks against opposite surfaces of a brake rotor so that the disks are free to rotate in three axes about their own centers (three degrees of freedom) and are free to translate in a direction parallel to the brake rotor rotational axis. These devices simultaneously press each disk against its corresponding rotor face at a single point on the disk using a follower which rolls on the non-abrasive side of the disk. Rotor rotation causes the disks to spin, and the disks float free on the rotor surfaces subject only to the force placed upon them by the rolling followers. Devices and methods according to the invention thus provide a true, nondirectional finish regardless of whether the devices are aligned correctly with respect to the rotor; the disks will remain correctly aligned with respect to the rotor, regardless of such misalignment (within reasonable limitations). Such devices and methods may also contemporaneously refine the surface finish of a previously machined piece, and they may be used to finish any article which has parallel surfaces.

According to the preferred embodiment of the invention, a frame attaches to a brake lathe and includes an adjustable horizontal support. Two bias arms are connected to the horizontal support at a predetermined distance apart so that the bias arms pivot about the support on an axis that is generally perpendicular to the brake rotor rotational axis. Each bias arm contains a spherical bearing. The bearing receives a disk axle so that the axle slides within the bearing and can rotate in any direction. Each axle carries a disk, and the axles and disks are positioned such that the inner, abrasive surfaces of the disks face one another. Each bias arm also supports a follower which is free to rotate on the outer face of its corresponding disk. A spring that spans the bias arms pulls the followers toward one another (but not the disk axles which slide in the spherical bearings) so that the followers bias the disks against the rotor face as the disks rotate and float on the rotor surfaces to provide a nondirectional finish.

Peak to valley rotor finish imperfections of 40 microinches are tolerable for anti-lock braking systems, and such finishes may be provided by some of the conventional devices mentioned above. Devices according to the present invention, however, have been found repeatedly to provide a nondirectional finish that substantially exceeds these tolerances.

It is accordingly an object of the present invention to provide a structurally simple rotor finisher that imparts a true and non-directional finish to brake rotors and similar articles.

It is another object of the present invention to provide a rotor finisher that requires no motorization of abrasion surfaces and whose abrasion surfaces present little risk of injury while in use.

It is an additional object of the present invention to provide a rotor finisher that is easy to use, inexpensive, adaptable to many varieties of brake lathes and other turning devices and thus conducive to widespread implementation and improvement in brake rotor finishing in automotive repair establishments and facilities throughout the world.

Other objects, features and advantages of the present invention will become apparent with reference to the remainder of this document.

DETAILED DESCRIPTION OF THE DRAWINGS

Figure 1:
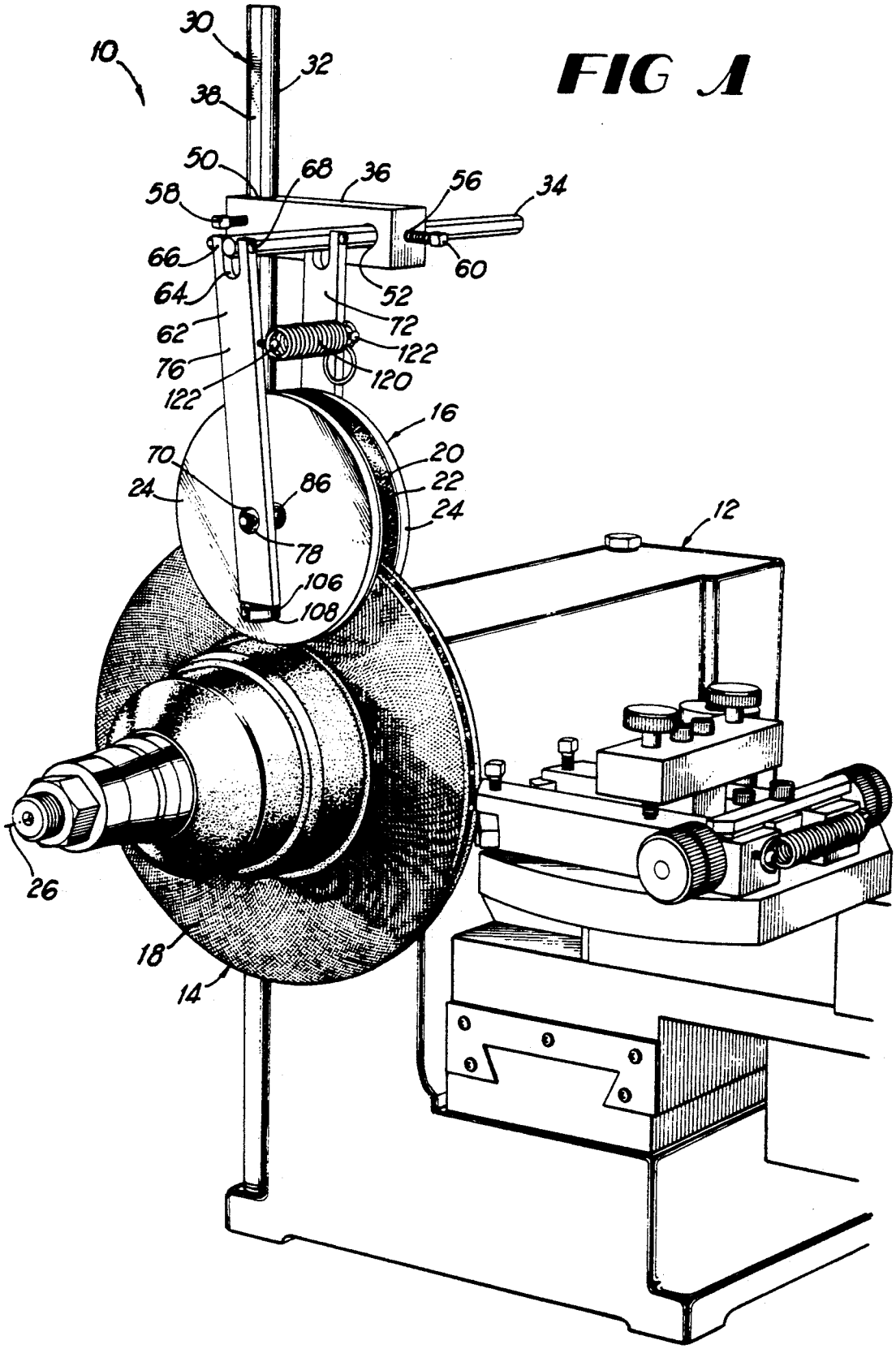
FIG. 1 is a perspective view of a preferred embodiment of a rotor finisher according to the present invention.

FIG. 1 shows a finisher 10 according to the present invention mounted on a brake lathe 12 to finish a disk brake rotor 14 mounted on the lathe 12. Finisher 10 may also be mounted on other turning devices that are suited to receive and turn brake disks or used in conjunction with any other device that can rotate rotors or articles that have parallel surfaces, including, if desired, being mounted on a component of the automobile on which the rotor is located.

Finishers of the present invention find their essence in two disks 16 and the manner in which those disks are biased against the faces 18 of rotor 14. Each disk 16 includes an inner surface 20 to which an abrasive layer 22 is attached and an outer surface 24. Each disk is supported at its approximate center so that it may rotate in any direction and translate (or move laterally) in a direction parallel to the axis of rotation 26 of rotor 14. Apart from these disks so suspended, the only other necessary feature of the invention is that each disk is pressed against its corresponding rotor face 18 at a place 28, substantially a point, in the area between the disk's center and the brake rotor rotational axis 26. Each disk 16 is thus free to float on its corresponding rotor face 18 about point 28 to impart a nondirectional, geometrically true finish to rotor 14. In essence, accordingly, the invention comprises a pair of disks so biased, together with means for biasing the disks and means for physically supporting the biasing means and the disks.

Figure 2:
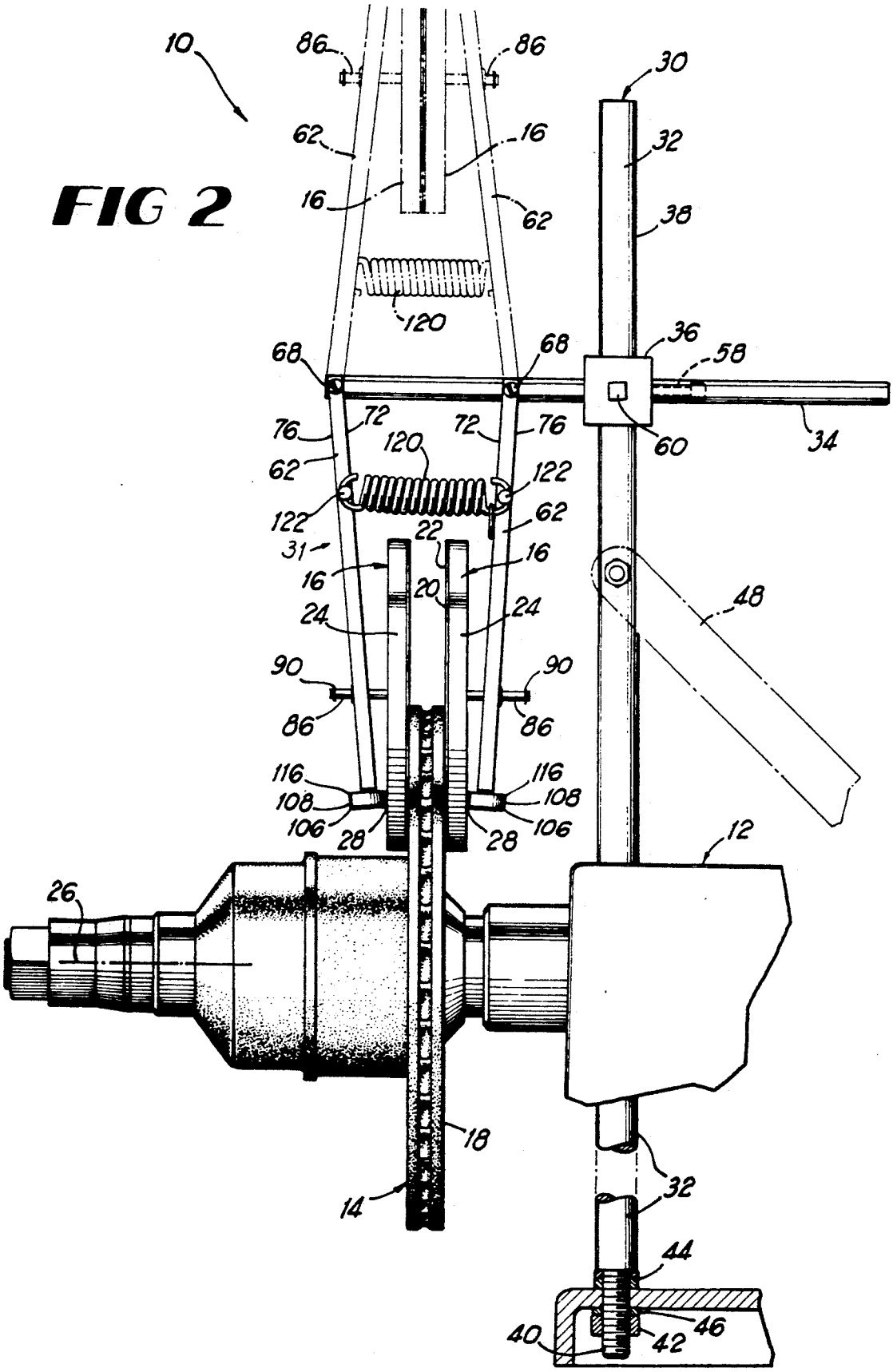
FIG. 2 is a front elevational view of the finisher of FIG. 1 showing the finisher retracted in relief.

The embodiment shown in FIGS. 1-5 utilizes a support 30 to support the biasing means and the disks. Support 30 in the preferred embodiment shown in these drawings includes a vertical bar 32 which is connected to lathe or turning means 12, a horizontal bar 34 to which the bias means are connected and an adjustable connector 36 which allows vertical bar 32 and horizontal bar 34 to be adjustably connected to one another. Vertical bar 32 in the preferred embodiment is a cylindrical shaft which contains a flat face 38 against which may impinge the face of a set screw. The end of vertical bar 32 opposite the end containing face 38 may be threaded with threads 40 to fit a mounting opening in lathe 12. A nut 42 cooperates with threads 40 and self-adjusting conical washers 44 (as well as lock washers 46) are employed as desired to align and mount vertical bar 32 on lathe 12. A brace 48 as shown in FIG. 2 may also be used if desired to stabilize vertical bar 32 further. Vertical bar 32 may also receive other fasteners (not shown) for additional stabilization and support with respect to lathe 12.

Connector 36 in the preferred embodiment comprises a block which has a first opening 50 corresponding generally in diameter to vertical bar 32 diameter, and a second opening 52 generally perpendicular to opening 50 and corresponding in diameter generally to that of horizontal bar 34. Each opening 50 and 52 communicates with a threaded bore 54 and 56, respectively, oriented perpendicular to the opening axis for receiving a set screw 58 and 60, respectively. Set screw 58 may be loosened to allow connector 36 to slide and be connected in desired position on vertical bar 32. Set screw 60 allows similar adjustment of horizontal bar 34 position with respect to connector 36 so that biasing means and disks 16 may be positioned as desired with respect to brake rotor 14.

Figure 3:
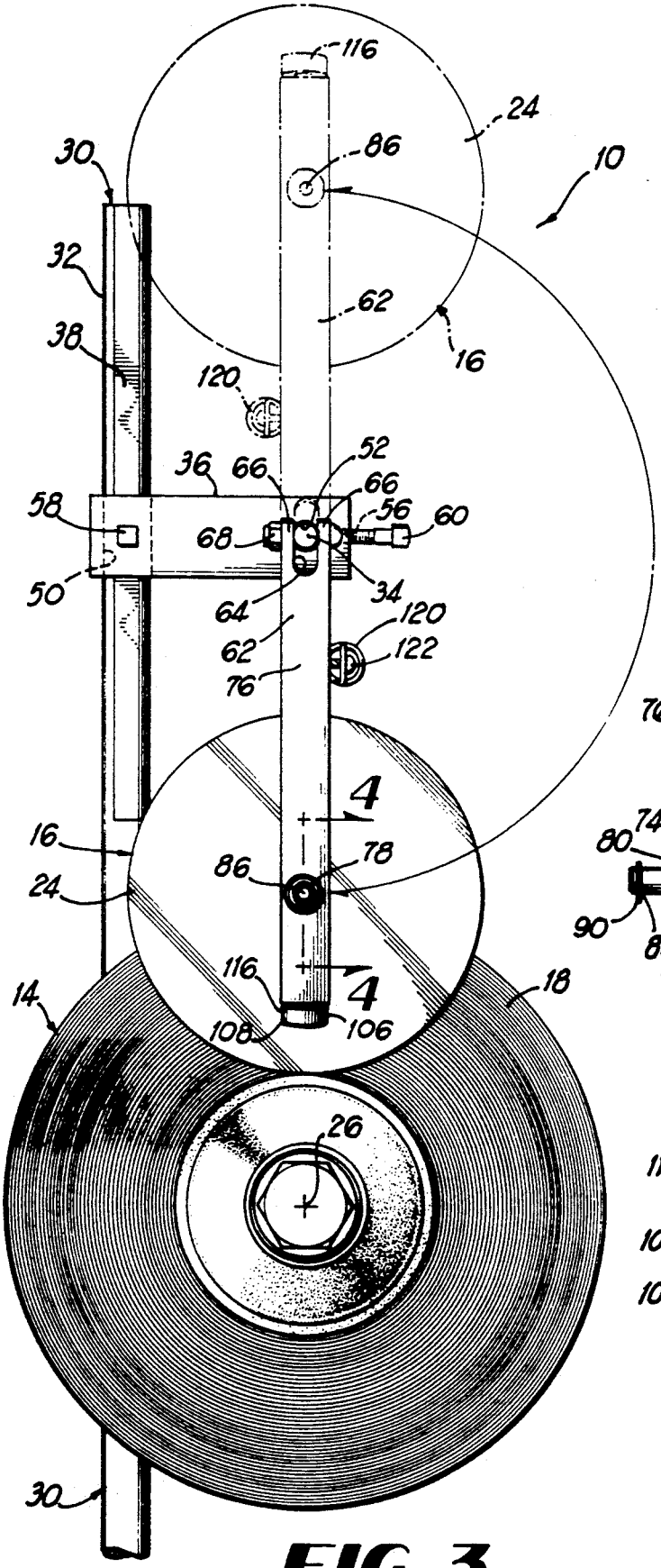
FIG. 3 is a side elevational view of the finisher of FIG. 1 showing the finisher retracted in relief.
Figure 4:
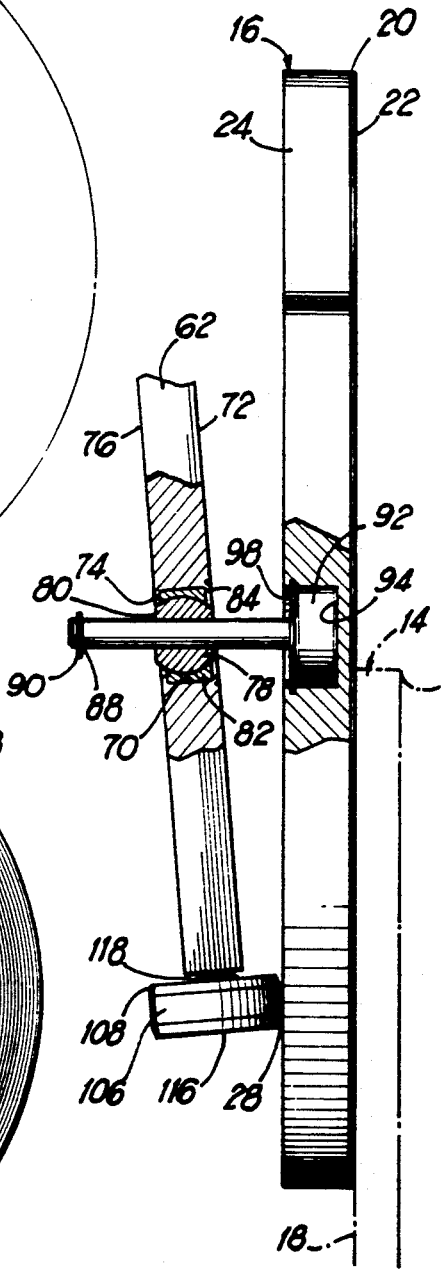
FIG. 4 is a partial front elevational, partial cross sectional view of the finisher of FIG. 3.

Horizontal bar 34 in the preferred embodiment may be formed of hexagonal stock so that set screw 60 may fasten horizontal bar 34 in desired rotational position in order to allow bias means and disks 16 to be rotated out of position with respect to disks 16 and secured when lathe 12 is used for other purposes. FIGS. 2 and 3 show finisher so retracted.

Support means 30 may comprise any support 30 with structural members of any desired composition and configuration, subject only to the consideration that they support biasing means 31 and disks 16 in place properly against brake rotor 14. These components in the preferred embodiment are of steel.

Bias means 31 of the preferred embodiment uses a pair of bias arms 62. The bias arms 62 of the device shown in FIG. 1 include a cutout area 64 which receives horizontal bar 34 and forms two legs 66 through which a fastener 68 extends to capture horizontal bar 34 so that bias arm 62 may pivot. Bias arms 62 are thus connected to horizontal bar 34 with fasteners 68 so that the bias arms 62 pivot with respect to horizontal bar 34 about an axis generally perpendicular to rotor rotational axis 26. Bias arms 62 may be formed of rectangular cross-section steel or of any other material and structure having desired performance and cost characteristics.

A cavity 70 is formed intermediate the two ends of each bias arm 62 for receiving the components that suspend and support disks 16. As shown more clearly in FIGS. 4 and 5, cavity 70 may be a hole drilled or otherwise formed in bias arm 62 from the side of the arm that faces its corresponding disk 16 (the "inner side 72") to leave a circumferential ledge or flange 74 on the other side of bias arm 62 (the "outer side 76").

Cavity 70 receives a spherical bearing assembly comprising a spherical bearing 80 having a cylindrical opening for receiving an axle, and a race 82 which receives the bearing 80. Spherical bearing assembly 78 may be inserted into cavity 70 and crimped into place by applying pressure to cylindrical crimp 84 that surrounds cavity 70 on inner side 72 of bias arm 62. Other types of bearing assemblies and methods of securing them to or within bias arms 62 may be utilized as well.

Each axle 86 slides in the cylindrical opening in its corresponding spherical bearing 80. The end of axle 86 which extends beyond the outer side 76 of bias arm 62 includes a cylindrical recess 88 which receives a snap ring fastener 90 that prohibits axle 86 from sliding out of spherical bearing 80. The other end of axle 86 is fitted with a bearing assembly 92 which supports disk 16. Axle 86 may be formed of a tubular section of any desired material, and bearing assembly 92 is a conventional bushing, ball or roller bearing set of appropriate size and characteristics to support disk 16.

Figure 5:
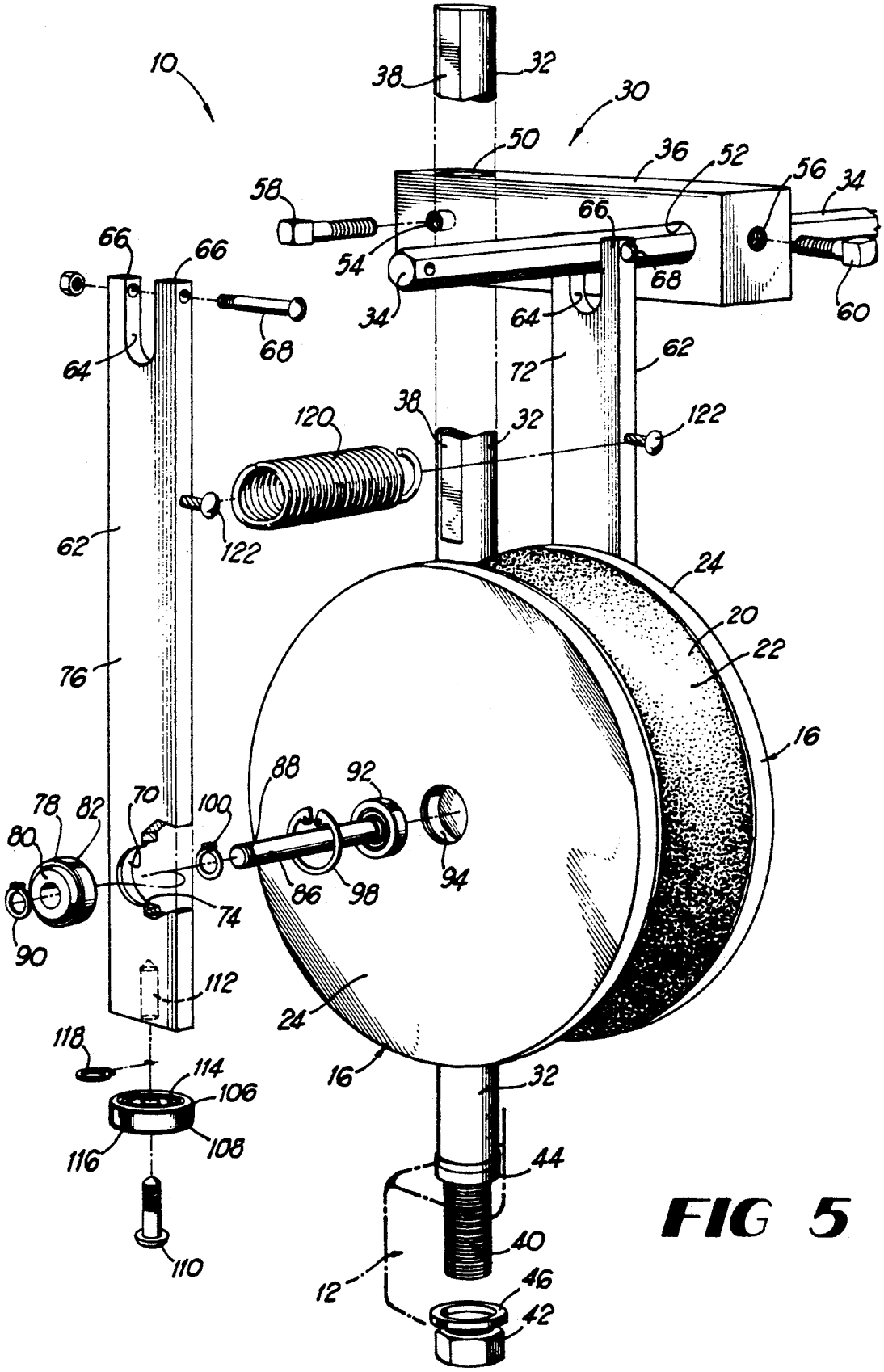
FIG. 5 is an exploded perspective view of a portion of the finisher of FIG. 1.

Disk 16 is a disk of any desired metallic or other material. In the preferred embodiment, disk 16 is formed of steel and is of approximately three inch radius and three-eights inch thickness. An opening 94 is drilled or otherwise formed in the center of the outer surface 24 of the disk. Opening 94 is of appropriate depth and radius to receive bearing assembly 92 snugly. Bearing assembly 92 is held in place in opening 94 with a snap ring fastener or other desired retainer 98. As shown in FIG. 5, a small third snap ring fastener 100 may fit on axle 86 between retainer 98 and spherical bearing assembly 78 to restrain bias arm 62.

The inner surface 20 of disk 16 receives a layer 22 of abrasive material. Silicon carbide material has been found a preferable adhesive for abrading rotors that comprise predominantly gray irons. Aluminum oxide is a preferable abrasive for many steels. Other natural or manmade abrasive materials may also be used. Grits may range from 36 to 500 or finer. Preferably, however, a grit in the range of 80 is used for heavy-duty applications while a grit of approximately 120 is suitable for general purposes. As a practical matter, grits above 180 are generally too fine for accomplishing the desired finishing within a reasonable amount of time.

The end of each bias arm 62 opposite the end connected to horizontal bar 34 supports a follower 106. Follower 106 in the preferred embodiment is a wheel 108. The wheel's axle is a screw 110 whose threads fit a threaded opening 112 that is formed in the end of bias arm 62 in a direction that will allow wheel 108 to roll on the outer surface 24 of disk 16. Wheel 108 in the preferred embodiment is a ball bearing assembly 114 around which is placed a tire of polyvinylchloride or other desired material. Other types of rotational assemblies may be used as well to form follower 106. Snap ring 118 fits around the shank of screw 110 in the preferred embodiment as a spacer and to retain wheel 108 in place on screw 110 during assembly.

A force means 120, preferably a spring, pulls bias arms 62 toward each other to position disks 16 against rotor faces 18 and to position followers 106 against disk outer surfaces 24. Air or hydraulic cylinders, elastic devices, screw mechanisms and other devices which can generate tension or pressure can be used. Followers 106 accordingly roll on disks 16 at a place 28, substantially a point, that is in the area between the disk 16 center and the rotor rotational axis 26. The force means 20 places equal pressure on both disks 16 in order to ensure substantially identical surface finishes on both rotor faces 18. Spring 120 may be attached to bias arms 62 by pins 122 which extend from bias arms 62 as shown in FIGS. 1, 2, 3 and 5. Spring 120 may also be attached to bias arms 62 nearer their longitudinal axes by eyes which extend from arms 62, through holes formed in arms 62 or by other desired means. A key chain style metallic loop may be placed around portions of an end of spring 120 to allow spring 120 to be more easily extended over pins 122.

Biasing means according to the invention may take forms other than bias arms 62 discussed above. Disks 16 may, for instance, be mounted at their centers on spherical bearings that ride two coaxial shafts, one of which fits inside the other. The shafts may be tensioned with respect to each other to press disks 16 together. Followers 106 in this embodiment may be positioned by arms which extend from the coaxial shafts or from portions of the support structure of the finisher.

In use, a brake rotor 14 is placed on the arbor of lathe 12 and finisher 10 is positioned as desired using connector 36 and set screws 58 and 60 to place the disks 16 against rotor faces 18. (Disks 16 have been fitted with appropriate abrasive layers 22.) The centers of disks 16 are preferably positioned in the approximate area of the periphery of rotor 14, but they may be positioned inside or outside that periphery. Lathe 12 is then actuated causing the disks to spin and finish rotor faces 18 in a nondirectional fashion. It has been found that the disks 16 will spin even if their centers are substantially within the periphery of rotor 14. At some point, rotation of the disks stops, however, and movement of the disk 16 centers further toward the center of rotor 14 causes the disks 16 to spin in the opposite direction.

The foregoing is provided for purposes of illustration and explanation. Modifications may be made without departing from the scope or spirit of the invention.

What is claimed is:

1. A finisher for finishing articles with parallel surfaces, comprising:

a. a support;

b. a pair of bias arms, an end of each respective bias arm defining a pivotal connection with the support at a predetermined distance from the other bias arm so as to permit the arms to pivot toward and away from each other with respect to the support;

c. a pair of disks, each of which is universally connected to one of the bias arms to rotate substantially about its center with at least two degrees of freedom with respect to the bias arm, and each of which has an inner and an outer face;

d. an abrasive surface attached to the inner face of each disk;

e. a follower rotatably attached to each bias arm; and f. resilient means connected between the bias arms to cause the bias arms to draw the followers against the disks so that (1) the disk abrasive surfaces contact and remain substantially parallel radially to an article placed between the disks and (2) rotation of the article causes the disks to spin and provide a non-directional finish for the article.

2. A finisher according to claim 1 in which the article is a brake rotor and the support is adapted to extend from a brake turning machine and comprises a first bar which extends from the machine and a second bar which is connected to the first arm to extend substantially horizontally and to which the biasing arms are connected.

3. A finisher according to claim 2 in which the support further comprises an adjustment block that connects the first and second bars, the adjustment block containing a first hole for receiving the first bar, a second hole for receiving the second bar, and a pair of set screws, each of which penetrates into a hole for retaining a bar in desired position.

4. A finisher according to claim 3 in which the adjustment block allows the second bar to pivot so that the bias arms and disks may be rotated away from the turning machine when the finisher is not in use.

5. A finisher according to claim 1 in which each of the bias arms pivots about its respective pivotal connection with respect to the support during operation of the finisher.

6. A finisher according to claim 1 in which each of the bias arms pivots about its respective pivotal connection as a function of the surface contour of the unfinished surface contacted by each respective abrasive surface.

7. A finisher according to claim 1 in which each of the bias arms pivots about its respective pivotal connection independently of each other during operation of the finisher.

8. A finisher according to claim 1 in which the connected end of each bias arm defines an angle with the support which may vary independently of the angle defined by the respective end of the other bias arm.

9. A finisher according to claim 1 in which each follower comprises a wheel rotatably mounted to its corresponding bias arm so that its rotational axis is substantially perpendicular to the axis on which the bias arm pivots about the support.

10. A finisher according to claim 1 in which the force means is a spring.

11. A finisher according to claim 1 in which, relative to the end at which each bias arm is connected to the support, the follower is attached to the arm farther than the point at which the disk is attached, and the disk is connected farther than the point at which the force means is connected.

12. A finisher for finishing brake rotors, comprising:

a. a support;

b. a pair of bias arms, an end of each of which is connected to the support at a predetermined distance from the other and so as to pivot with respect to the support, each arm containing:

(1) a cavity formed a predetermined distance from the end at which the bias arm is connected to the support, and substantially perpendicular to the axis about which the bias arm pivots; and (2) a spherical bearing disposed in the cavity to rotate with at least two degrees of freedom with respect to the bias arm;

c. a pair of disk axles, each of which is connected to one of the spherical bearings in sliding relationship;

d. a pair of disks, the approximate center of each of which is rotatably connected to one of the disk axles and each of which has an inner and an outer surface;

e. an abrasive surface attached to the inner surface of each disk;

f. at least one follower rotatably mounted to each bias arm away from the end at which the bias arm is mounted to the support, relative to the cavity; and g. a spring connected to the bias arms to cause the bias arms to force the followers against the disks so that (1) the abrasive surfaces contact and remain substantially parallel radially to a rotor placed between the disks and (2) rotation of the rotor causes the disks to spin and finish the rotor.

13. A finisher according to claim 12 in which the support is adapted to extend from a mounting surface and comprises:

a. a first bar which extends from the surface;

b. a second bar which is connected to the first bar to extend substantially horizontally and to which the bias arms are connected; and c. an adjustment block connecting the first and second bars, which contains:

(1) a first hole for receiving the first bar;

(2) a second hole for receiving the second bar; and (3) a pair of set screws, each of which penetrates radially into a hole for retaining a bar in desired position.

14. A finisher according to claim 12 in which, relative to the end at which each bias arm is connected to the support, the follower is mounted at a point farther than the bearing cavity, and the bearing cavity is located farther than the point at which the spring is connected.

15. A finisher for finishing articles with parallel surfaces, which may be mounted to a device for turning such articles, comprising:

a. a first bar extending substantially vertically from the turning machine;

b. an adjustment block slidably and rotatably connected to the first bar and including a set screw for retaining the block in desired position on the first bar;

c. a second bar slidably and rotatably connected to the adjustment block and retained in desired position by a second set screw included in the block;

d. a pair of elongated bias arms, one end of each of which is pivotally connected to the second bar, and each of which comprises:

(1) a cavity formed a predetermined distance from the end at which the bias arm is connected to the second bar, and substantially perpendicular to the axis about which the bias arm pivots; and (2) a spherical bearing disposed in the cavity to rotate with three degrees of freedom with respect to the bias arm;

e. a pair of disk axles, each of which is slidably received in a spherical bearing;

f. a pair of disks, the approximate center of each of which is rotatably attached to a disk axle, and each of which includes an inner and an outer surface;

g. an abrasive surface attached to the inner surface of each disk;

h. a follower rotatably mounted to the end of each bias arm opposite the end at which the arm is connected to the second bar; and i. a spring connected to the arms between the cavities and the points at which the arms are connected to the second bar to force the followers against the disks so that (1) the abrasive surfaces contact and remain substantially parallel radially to an article placed between the disks and (2) rotation of the article causes the disks to spin.

16. A device for providing a non-directional finish to an article with parallel surfaces rotatable about an axis, for mounting on a device for turning such articles, comprising:

a. a pair of disks, each of which includes a disk center and an abrasive surface;

b. a pair of bias means universally connected to the disks the bias means comprising:

(1) means for positioning the disk abrasive surfaces against the article surfaces without constraining the disks from rotation in any direction, or from translation in a direction generally parallel to the article rotational axis; and (2) means for pressing the disks against the article surfaces at a place on each disk that is in an area between the disk center and the article rotational axis; and c. resilient support means connected between the pair of bias means so that they may pivot toward and away from one another at least partially independently from each other for supporting the bias means and disks on the turning device.

17. A finisher for finishing articles with parallel surfaces, comprising:

a. a support;

b. a pair of bias arms, an end of each of which is connected to the support at a predetermined distance from the other and so as to pivot with respect to the support, each bias arm comprising:

(1) a cavity formed a predetermined distance from the end at which the biasing arm is connected to the support, and substantially perpendicular to the axis about which the bias arm pivots; and (2) a spherical bearing for connection to a disk axle and disposed in the cavity to rotate with at least two degrees of freedom with respect to the bias arm;

c. a pair of disks, each of which is connected to one of the disk axles to rotate substantially about its center with at least two degrees of freedom with respect to the bias arm, and each of which has an inner and an outer face;

d. an abrasive surface attached to the inner face of each disk;

e. a follower rotatably attached to each bias arm; and f. means connected to the bias arms to cause the bias arms to force the followers against the disks so that (1) the disk abrasive surfaces contact and remain substantially parallel radially to an article placed between the disks and (2) rotation of the article causes the disks to spin and finish the article.

18. A finisher according to claim 17 in which the spherical bearing contains a hole which receives the axle in a sliding relationship.

19. A device for providing a nondirectional finish to articles with parallel surfaces, which device may be mounted on a device for turning such articles, comprising:

a. support means for supporting the finishing device on the turning device;

b. a pair of disks, each of which includes an abrasive surface; and c. bias means connected to the support means and the disks for positioning the disk abrasive surfaces against the article surfaces without constraining the disks from rotation in any direction, or from translation in a direction generally parallel to the article rotational axis, and for pressing the disks against the article surfaces at a place on each disk that is in an area between the disk center and the article rotational axis; the bias means comprising:

(1) a pair of bias arms, an end of each of which is connected to the support means at a predetermined distance from the other and so as to pivot with respect to the support means, each arm containing:

(a) a cavity formed a predetermined distance from the end at which the bias arm is connected to the support means, and substantially perpendicular to the axis about which the bias arm pivots; and (b) a spherical bearing disposed in the cavity to rotate with at least two degrees of freedom with respect to the bias arm;

(2) a pair of disk axles, each of which is connected to one of the spherical bearings in sliding relationship and carries one of the disks;

(3) a follower mounted on each bias arm at an end opposite the end at which the arm is connected to the support means; and (4) force means for forcing the bias arms toward each other and the followers against the disks.

* * * * *